United States Patent [19]

Holliday

[11] Patent Number: 4,550,818

[45] Date of Patent: Nov. 5, 1985

[54] COIN HANDLING APPARATUS FOR USE IN MERCHANDISE VENDING MACHINES

[76] Inventor: Robert A. Holliday, 4046 N. 80th Dr., Phoenix, Ariz. 85033

[21] Appl. No.: 544,791

[22] Filed: Oct. 24, 1983

[51] Int. Cl.[4] ..... G07F 9/04

[52] U.S. Cl. ..... 194/1 D; 194/1 N

[58] Field of Search ..... 194/1 C, 1 D, DIG. 28, 194/DIG. 29, DIG. 27, DIG. 15, 1 N

[56] References Cited

U.S. PATENT DOCUMENTS 2,925,898 2/1960 Terry ..... 194/DIG. 28

*Primary Examiner*—Stanley H. Tollberg

*Attorney, Agent, or Firm*—Herbert E. Haynes, Jr.

[57] ABSTRACT

A coin handling apparatus for use with a vending machine with the coin handling apparatus including an especially configured escrow box which is capable of handling relatively large quantities of coins without the coin jamming and incomplete emptying problems of the prior art. The special escrow box includes a coin return gate and a vend gate which cooperatively form a V-shaped escrow box when the gates are closed. The coin return gate is pivotably movable about a pivot point located at the vertex of the V-shaped escrow box and the vend gate is pivotably movable about a pivot point on its uppermost end so as to completely and rapidly open one entire side of the escrow box when the downwardly extending end of the vend gate is swung away from the vertex of the V-shaped escrow box upon opening of the vend gate.

23 Claims, 5 Drawing Figures

10
12
13
14
15
16
17
18
19
20
22
24
26
27
28
29
30
31
32
34
36
37
38
39
40
42
43
44
45
46
48
50
52
53
54
55
56
58
60
61
62
64
66
68
70
72
74
76
78
80
82
84
86
87
90
91
92
93
94
96
97
98
100
102
103
104
106
110
112
114
116
118
119
120
122
124

COIN HANDLING APPARATUS FOR USE IN MERCHANDISE VENDING MACHINES

BACKGROUND OF THE INVENTION

1. Field of the Invention

This invention relates in general to coin operated vending machines and more particularly to an improved coin handling apparatus for enabling such machines to vend merchandise having relatively high purchase prices.

2. Description of the Prior Art

Coin operated merchandise vending machines which have operated successfully for many years are having operational problems due to the inflated costs of the merchandise currently being vended by the machines. For example, it takes considerably more coins to purchase a package of cigarettes at the present price of over one dollar than it did to purchase the same package a few years ago at a price of fifty cents or less.

In the past, vending machines used what is referred to as a mechanical totalizer for counting the coins which are inserted into the machine for vending operations. The problem with mechanical totalizers is that they were limited to vend price amounts of less than one dollar. This problem was overcome by the advent of what is referred to as an electronic totalizer which can be easily set to various product vend prices for amounts up to six dollars or more.

While the coin totalizers and vend price reset capabilities of coin handling apparatuses used in vending machines have been improved by the electronic totalizer, the mechanical mechanisms which physically handle the coins have not kept pace.

A coin handling apparatus receives coins from a coin accepting mechanism which is designed to reject invalid coins, such as badly damaged coins, slugs, and the like, and to accept valid coins. The invalid coins are directed through the coin handling apparatus to the coin return tray of the vending machine. Valid coins are directed by the coin acceptance mechanism to a coin detector and totalizer of the coin handling apparatus which counts the coins and directs them into what is referred to as an escrow box, or area. When the totalizer senses that the inserted coins add up to the preset vend price, it operates a vend enable latch in the vending machine which allows the customer to select the desired product or have the money returned to him if he changes his mind. If the customer selects a product, a vend shaft of the vending machine, which extends into the coin handling apparatus, is rotated to open a normally closed vend gate of the escrow box so that the coins will fall through a coin chute provided in the coin handling apparatus into a coin box of the vending machine. On the other hand, if the customer changes his mind and wants his money returned, by operating the appropriate lever of the vending machine, a coin return lever on the coin handling apparatus is moved to open a normally closed coin return gate of the escrow box which allows the coins to fall through a coin return bin of the coin handling apparatus which directs the returning coin to the tray of the vending machine.

The physical, i.e., mechanical problems of the prior art coin handling apparatuses of the above described type are that the escrow boxes are too small to accomodate the large numbers of coins needed to reach the inflated vend prices and they operate too slow to reliably handle the multiplicity of coins.

With regard to the size of the prior art escrow boxes, the multiplicity of coins sometimes causes them to jam up in the escrow box. When this occurs, the customer can become upset if he decides not to purchase any of the vended merchandise and operates the coin return lever provided on the vending machine. Most of the time, however, the customer can get his money back by repeatedly operating the coin return lever. When the customer does make a product selection and some, or all of the coins remain in the escrow box due to jamming, that customer will receive his merchandise and the next customer could receive some or all of the jammed-up coins if he operates the coin return lever of the vending machine.

The coin jamming problem could be eliminated, or at least substantially reduced, by lengthening the vend and coin return gates and thereby increasing the coin capacity or size of the escrow box. This however would be difficult due to space limitations and it would increase the severity of another problem associated with the prior art coin handling apparatus. The other problem concerns the slow operation of the prior art escrow boxes and their inability to reliably and completely empty the escrow boxes after a customer makes his product selection.

The problem of slow operation of the escrow boxes results from the coin return gate and the vend gate being pivotably mounted on a common pivot post and cooperatively forming an upwardly opening V-shaped configuration of about 90° in their normally closed positions. When the customer makes a product selection, the vend shaft of the vending machine pivotably moves the vend gate through approximately 90° of rotation to a position where the open vend gate slopes angularly downwardly from the pivot post at an angle of about 45°. The coins in the escrow box are supposed to slide down the angularly disposed open vend gate and fall into the coin chute. However, the opening and subsequent closing of the vend gate is accomplished in a relatively short period of time, due to the inherent operating characteristics of the vending machine, and this can result in some of the coins not even reaching the open vend gate before it starts to close, and those coins which are sliding down the open vend gate when it begins to close can be flipped back up into the escrow box.

As was the case in the hereinbefore described coin jamming problem, any coins left in the escrow box due to the slow operation and resulting incomplete emptying thereof, could be delivered to the next customer instead of being directed into the coin box of the vending machine. Therefore, if the vend gate were lengthened to eliminate or at least reduce the coin jamming problem, it would take longer for the coins to slide down the open vend gate and this would increase the severity of the escrow box emptying problem.

Therefore, a need exists for a new and improved coin handling apparatus which overcomes, or at least substantially reduces, the problems and shortcomings of the prior art. 1

SUMMARY OF THE INVENTION

In accordance with the present invention, a new and improved coin handling apparatus is disclosed for use in merchandise vending machines. The coin handling apparatus is designed as a complete unit which replaces outdated prior art mechanisms in existing machines, and can be utilized in new equipment as well.

The improved coin handling apparatus includes a special housing having a coin detector and electronic totalizer of the type hereinbefore described which counts and directs valid coins to an especially configured escrow box. The escrow box is a large capacity fast operating mechanism which overcomes the prior art problems of coin jamming and incomplete emptying. The escrow box includes a return gate which is pivotably mounted on a first pivot pin and a vend gate which is pivotably mounted on a separate second pivot pin. When the return and vend gates are in their normally closed positions they cooperatively form an upwardly open V-shaped configuration of approximately 90°. The first pivot pin, upon which the coin return gate is pivotably carried, is located at the vertex of the two gates, and the second pivot pin, upon which the vend gate is pivotably mounted, is located at the uppermost end of the vend gate. When the customer selectively activates the coin return gate, it opens by being pivotably moved approximately 90° to where it slopes angularly downwardly at an angle of about 45° from its vertex-located pivot pin, and thus is similar in operation to the prior art coin return gate mechanism. However, when the customer makes a product selection, the vend gate is pivotably moved about its separate pivot pin, so that it swings away from the vertex of the V-shaped escrow box so that the entire side of the escrow box is quickly and completely opened. By locating the vend gate pivot pin at the upper end of the vend gate, and opening it as described above, the coins will fall freely from the escrow box as opposed to sliding down the open angularly disposed gate of the prior art coin handling mechanism, thus, overcoming the prior art problem of incomplete emptying of the escrow box. The pivot pin location and swing-away opening of the vend gate also allows the vend gate to be considerably longer than the prior art vend gate thus effectively enlarging the escrow box and overcoming the coin jamming problem.

The rotatable vend shaft of the vending machine extends through the housing of the coin handling apparatus of the present invention, and a special vend cam is carried on the end of the vend shaft for rotation therewith. When the vend shaft is rotated to its operating position in response to a customer making a product selection, the vend cam engages the vend gate and moves it to its open position against a spring biasing force which yieldably holds the vend gate in its normally closed position. A cam follower, or lockout, lever is also mounted on the housing which when in its normal position, i.e., in the absence of vend shaft rotation, positively holds the vend gate closed against unintentional opening, such as could occur as the result of the weight of the coins, and frees the coin return gate for opening should the customer want his money back. When the customer makes a product selection, the vend cam moves the cam follower lever so that it frees the vend gate for opening and holds the coin return gate closed so that a customer cannot get both his money back and the vended product by simultaneously operating both the product selection and coin return levers of the vending machine.

Accordingly, it is an object of the present invention to provide a new and improved coin handling apparatus for use in merchandise vending machines.

Another object of the present invention is to provide a new and improved coin handling apparatus which is capable of handling the relatively large numbers of coins which are needed to arrive at high merchandise vending prices.

Another object of the present invention is to provide a new and improved coin handling apparatus which is designed as a complete unit for replacing outdated coin handling mechanisms which are incapable of reliably and otherwise handling the large numbers of coins needed to arrive at relatively high merchandise vending prices.

Another object of the present invention is to provide a coin handling apparatus of the above described character which includes an electronic coin totalizer which facilitates changing of merchandise vending prices up to relatively high values.

Another object of the present invention is to provide a coin handling apparatus of the above described type which includes a large coin capacity fast operating escrow box which overcomes the prior art problems of coin jamming and incomplete emptying.

Another object of the present invention is to provide a coin handling apparatus of the above described character wherein the escrow box includes a coin return gate and an elongated vend gate which form a V-shaped escrow box with the vend gate being pivotably mounted on a pivot pin which is located at its uppermost end so that the vend gate will swing away from the vertex of the V-shaped escrow box to completely open one entire side thereof for rapidly and totally emptying the coins from the escrow box.

Still another object of the present invention is to provide a coin handling apparatus of the above described character which includes a vend cam for operation of the vend gate and a lockout lever which, in the absence of a customer making a product selection, holds the vend gate closed and allows the coin return gate to be opened.

Yet another object of the present invention is to provide a coin handling apparatus of the above described type wherein the lockout lever is moved by rotation of the vend cam, in response to a customer making a product selection, to a position where the vend gate is free to be opened and the coin return gate is held against simultaneous opening.

The foregoing and other object of the present invention as well as the invention itself, may be more fully understood from the following description when read in conjunction with the accompanying drawings.

DESCRIPTION OF THE PREFERRED EMBODIMENT

Figure 1:
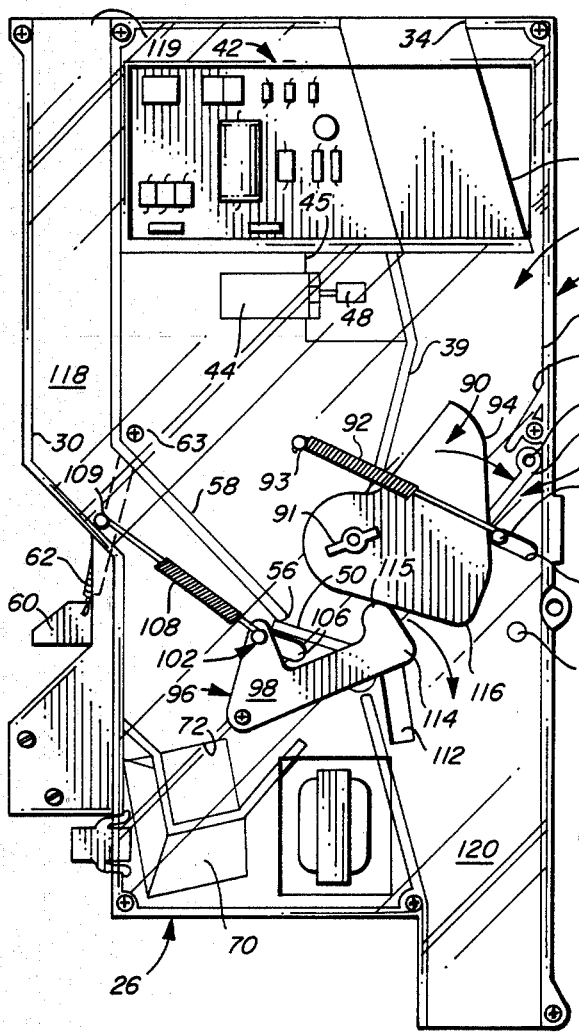
FIG. 1 is a front elevational view of the coin handling apparatus of the present invention.
Figure 2:
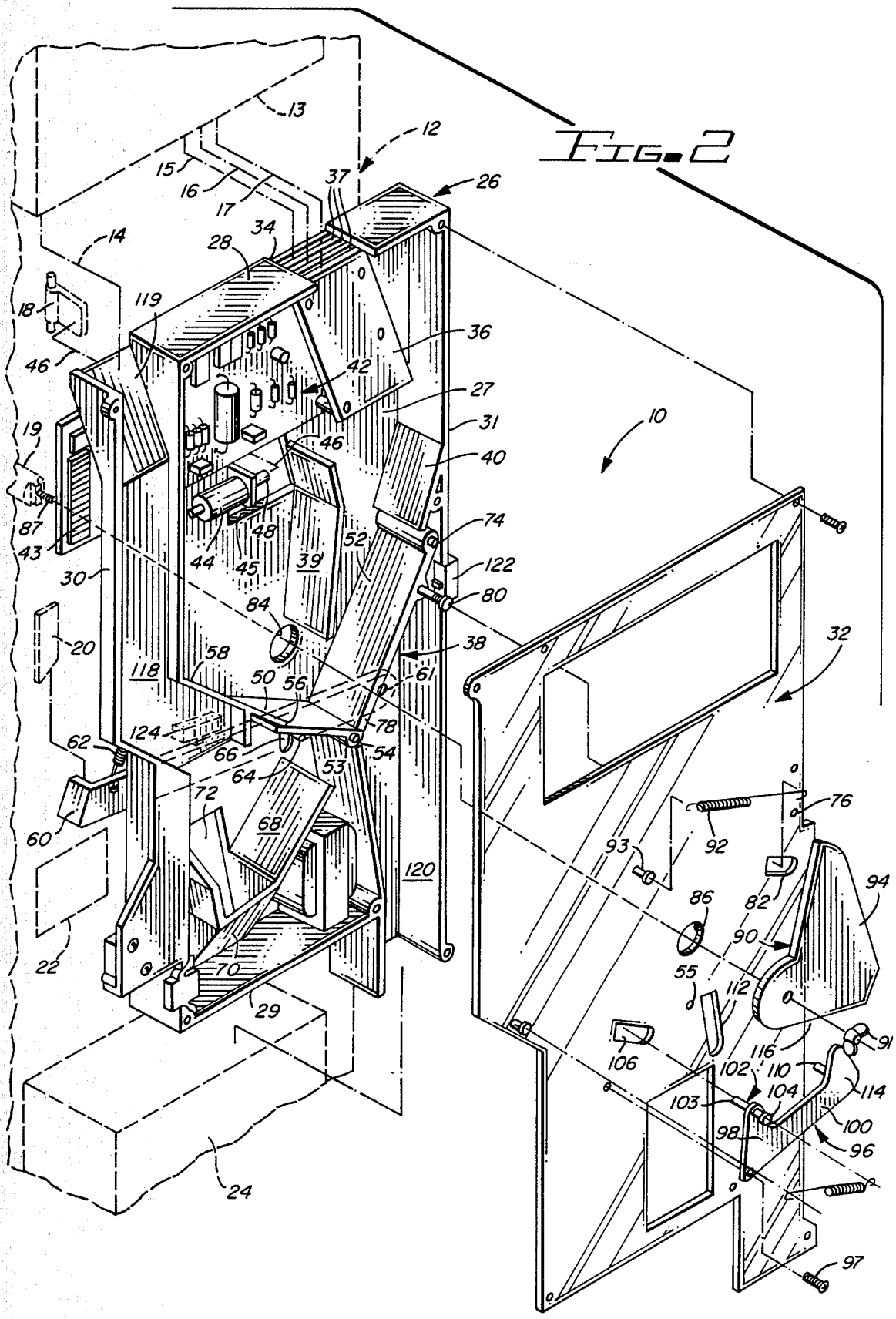
FIG. 2 is an enlarged perspective exploded view of the coin handling apparatus of the present invention showing the various features thereof and showing fragmentary portions of a typical vending machine in which the coin handling apparatus is usable.

Referring more particularly to the drawings, FIGS. 1 and 2 show the coin handling apparatus of the present invention with the apparatus being indicated in its entirety by the reference numeral 10.

As hereinbefore mentioned, the coin handling apparatus 10 is designed as a replacement unit for prior art coin handling devices in existing vending machines, or may be used in new vending machines. Therefore, it is believed to be appropriate to provide a brief description of a typical vending machine prior to proceeding with the detailed description of the coin handling apparatus 10. Vending machines of the appropriate type are well known in the art, thus, the vending machine is not fully illustrated and the following description of the machine will be only in sufficient detail to facilitate a complete understanding of the apparatus 10 of the present invention.

As shown in FIG. 2, the vending machine 12, which is shown in phantom lines, includes a coin acceptance device 13 which receives coins that are inserted into the machine 12. Invalid coins, such as slugs, are detected in the acceptance device 13 and are directed therethrough so that they fall from the acceptance device 13 in a coin reject path 14. Valid coins are detected in the coin acceptance device 13 and are segregated therein in accordance with the value of the valid coins. Accordingly, nickels fall from the acceptance device 13 in a first valid coin path 15, dimes in a second valid coin path 16, and quarters in a third solid coin path 17. The vending machine 12 also includes a pivotably movable vend enable latch 18, a rotatably vend shaft 19, and a linearly movable coin return actuation bar 20, all of which interact with the coin handling apparatus 10 of the present invention as will hereinafter be described. The vending machine 12 further includes a coin return chute 22 which is disposed to receive both invalid and valid coins from the coin handling apparatus 10 which are to be returned to the coin return tray (not shown) of the vending machine, and a cash box 24 to receive and store coins which are spent to purchase a product which is vended by the vending machine 12.

The coin handling apparatus 10, as seen best in FIG. 2, includes a housing 26 of substantially rectangular configuration having a back wall 27, top wall 28, bottom wall 29, and opposed side walls 30 and 31, all of which cooperatively define a forwardly opening cavity. A cover 32 is demountably attached on the open front of the housing 26 for reasons which will become apparent as this description progresses. As shown, the cover 32 is preferably transparent so that operation of the coin handling apparatus 10 may be observed by service personnel to facilitate trouble-shooting and servicing.

The top wall 28 of the housing 26 is open as at 34 and a suitable coin detector 36 is mounted immediately below the opening 34. The coin detector 36 is provided with three separate slots 37 for receiving the valid coins falling from the acceptance device 13 in the first, second and third valid coin paths 15, 16 and 17, respectively. The coin detector 36, as is well known in the art, senses the presence of coins which fall therethrough and produce appropriate signals for each falling coin. Coin detectors of this sort are usually photo-electric devices which produce different signals for coins of different values.

As will hereinafter be described in detail, the coins which fall through the coin detector 36 fall into an escrow box 38 by passing between a partition 39 which is integrally formed in the cavity of the housing 26, and a deflector wall 40 which extends angularly inwardly and downwardly from the side wall 31 of the housing 26.

The signals produced by the coin detector 36 are directed to a coin totalizer 42 which, as is customary in the art, is a device which receives and counts the signals to determine if the monitary value of the coins received is equal to the vend price of the products vended by the machine 12. The coin totalizer 42 includes suitable price selector switches 43 by which the totalizer may be preset to various monitary values. When the coin totalizer 42 determines that the value of the coins received is equal to the preset vend price, it produces a vend enable signal which energizes a transducer in the form of a vend enable solenoid 44 which is mounted in the cavity of the housing 26 proximate an opening 45 which is formed through the back wall 27 of the housing. As indicated by the explode line 46 of FIG. 2, the vend enable latch 18 of the vending machine 12 is disposed in the opening 45 of the housing 26 when the apparatus 10 is mounted in the vending machine 12. When the solenoid 44 is energized, its plunger 48 will extend axially therefrom and pivotably move the vend enable latch 18 from the illustrated vend disable position to an enable position. When the vend enable latch is moved to its vend enable position, it frees the vending machine 12 so that the product selected by the person who inserted the coins maybe vended by the machine. When the vending machine 12 is free to vend the product, the vend shaft 19 of the vending machine will be rotated for delivering the selected product, and such rotation of the vend shaft 19 will operate the coin handling apparatus 10 in a manner to hereinafter be described in detail.

The escrow box 38 includes a coin return gate 50 and a vend gate 52 which cooperatively define an upwardly opening structure of V-shaped configuration when those gates are in their normally closed position.

Figure 3:
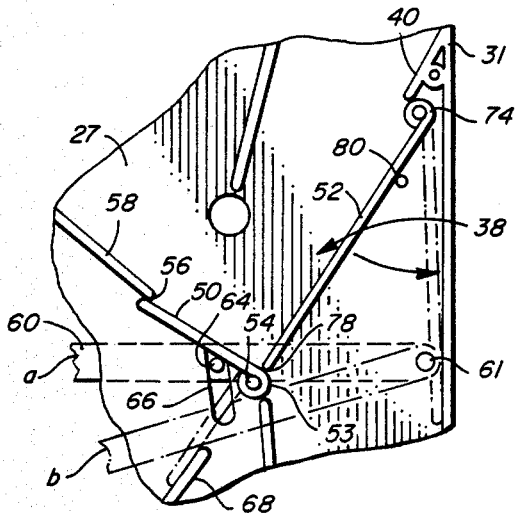
FIG. 3 is a fragmentary elevational view of the escrow box portion of the coin handling apparatus of the present invention with the front cover being removed therefrom to show the movements of the return gate and the vend gate of the escrow box.

The coin return gate 50 is formed within a tubular structure 53 transversely on one end thereof which is coaxially mounted on and pivotably movable about a pivot pin 54. The pivot pin 54 is located at the vertex of the two gates 50 and 52, and extends from the back wall 27 of the housing 26 through the cavity defined thereby, with the extending end of the pin being supportingly carried in an aligned aperture 55 formed through the cover 32. The coin return gate 50 is normally in the closed position wherein it extends angularly upwardly from the pivot pin 54 with the extending end of the coin return gate being in engagement with the bottom end 56 of a partition 58 which is integrally formed with the housing 26 so as to extend from the back wall 27 thereof into the cavity defined by the housing 26. The coin return gate 50 is held in its normally closed position by a coin return lever 60 which is mounted on the back surface of the back wall 27 of the housing 26. The coin return lever 60 is mounted by and pivotably movable about a pin 61 which is carried in the back wall of the housing 26, and the lever 60 is biased to an upwardly disposed pivoted position by means of a suitable spring 62 one end of which is attached to the lever 60 with the opposite end thereof being attached to a pin 63 that is carried in the back wall 27 of the housing 26. A holding pin 64 extends from the coin return lever 60 through a slot 66 formed in the back wall 27 of the housing 26, with the holding pin 64 being in bearing engagement with the angularly downwardly facing surface of the coin return gate 50. When the coin return lever 60 is in its normal position which is shown in FIGS. 1 and 2, and is indicated at a in FIG. 3, the holding pin 62 will hold the coin return gate 50 in the closed position wherein its extending end is in bearing engagement with the bottom end 56 of the partition 58. The partition 58 acts as a stop to limit the clockwise movement of the coin return gate 50 about its pivot pin 54 and also acts as a stop for movement in the same direction of the coin return lever 60 about its pivot pin 61.

The coin return gate 50 will be held in its normally closed position at all times except when a person who deposited coins in the vending machine 12 changes his mind and wants his money back. When this occurs, the person operates the appropriate device (not shown) on the vending machine 12 and this results in a downward linear movement of the coin return actuator bar 20 of the vending machine 12. As indicated by the explode line in FIG. 2, the coin return actuator bar 20 is in engagement with the extending end of the coin return lever 60 when the apparatus 10 is mounted in the vending machine 12. When the coin return actuator bar 20 is moved down, as described above, it will pivotably move the coin return lever 60, against the bias applied thereto by the spring 62, about its pivot pin 61 to the position indicated at b in FIG. 3. Such pivot movement of the lever 60 will move the holding pin 64 thereof downwardly in the slot 66 and the weight of the coin return gate 50 and any coins which maybe in the escrow box 38, will cause the coin return gate 50 to pivotably move in the counterclockwise direction about its pivot pin 54 to the open position shown in phantom lines in FIG. 3.

When the coin return gate 50 is opened as described above, it will move through approximately 90° of rotation into a downwardly angularly sloping position in which it rests on a similarly sloping wall 68 that is part of a coin directing bin structure 70 which is integrally formed with the housing 26 so as to extend from the back wall 27 of the housing 26 into the cavity defined thereby. Any coins which fall from the escrow box 38 through the open coin return gate 50 will be caught by the coin directing bin structure 70 and passed through an opening 72 provided in the back wall 27 of the housing 26 so as to align with the coin return chute 22 of the vending machine 12, when the coin handling apparatus 10 is mounted therein.

The vend gate 52 of the escrow box 38 is pivotably mounted on a pivot pin 74 which is located adjacent the side wall 31 of the housing 26 immediately below the deflector wall 40. The pivot pin 74 extends from the back wall 27 of the housing 26 into the cavity defined thereby with the extending end of the pivot pin 74 being supportingly carried in an aligned aperture 76 formed in the cover 32. The vend gate 52 is pivotably movable about the pivot pin 74 from its closed position shown in solid lines in FIG. 3 to its open position shown in phantom lines in the same figure. When closed, the vend gate 52 extends angularly downwardly from the pivot pin 74 and its depending end 78 is held in bearing engagement with the tubular structure 53 of the coin return gate 50. When the vend gate 52 is opened, it will move through approximately 60° of rotation in the counterclockwise direction wherein it will depend substantially vertically from the pivot pin 74. The vend gate 52 is provided with an operating pin 80 which is disposed intermediate its opposite ends and extends therefrom through a slot 82 which is aligningly formed in the cover 32. The purpose of the operating pin 80 and the means for moving the vend gate 52 will hereinafter be described in detail.

As seen best in FIG. 2, when the apparatus 10 is mounted in the vending machine 12, the vend shaft 19 of the vending machine 12 extends therefrom through an aperture 84 formed in the back wall 27 of the housing 26, passes through the cavity defined by the housing 26, and extends through an aligned aperture 86 formed in the cover 32. A threaded stud 87 extends axially from the vend shaft 19, and a vend cam 90 is demountably attached to the stud 87 by means of a suitable nut 91, so that the vend cam 90 is rotatably movable with the vend shaft. A tension spring 92 having one end attached to a peg 93, that is provided on the outwardly facing surface of the cover 32, extends from the peg 93 across a portion of the outwardly facing surface of the vend cam 90, and the other end of the spring 92 is in hooked engagement with the operating pin 80 of the vend gate 52. The spring 92 biases the vend gate 52 to its closed position and holds the operating pin 80 so that it is proximate, or in bearing engagement with, a first cam surface 94 formed on the vend cam 90. When the vend shaft 19 is rotatably operated from its non-operating position, as a function of the vending machine 12, to its operated position as hereinbefore described, the vend cam 90 will rotate in the clockwise direction as viewed in FIGS. 4 and 5 from its normal position shown in FIG. 4 to its operated position shown in FIG. 5. When so rotated, the first cam surface 94 will bear against the operating pin 80 of the vend gate 52 and move the pin in the slot 82 and thereby move the vend gate to its open position.

Due to the location of the vend gate pivot pin 74 and the resulting swinging opening movement of the vend gate 52, the entire right-hand side of the escrow box 38, as viewed through the transparent cover 32, will be rapidly opened during a vend operation of the vending machine 12. Such rapid and complete opening of the escrow box 38 will completely empty the contents of the escrow box thus eliminating the coin jamming and flip-back problems of the prior art.

In order to prevent simultaneous opening of the coin return gate 50 and the vend gate 52, which could otherwise occur if a person simultaneously operates the coin return and product selection devices (not shown) of the vending machine 12, the coin handling apparatus 10 is provided with a lockout lever 96. The lockout lever 96 is pivotably mounted on the cover 32 by a suitable screw 97. As seen best in FIGS. 4 and 5, the lockout lever is of substantially V-shaped configuration having a first arm 98 and an elongated second arm 100, with the pivot screw 97 being disposed at the vertex of the lever.

The relatively shorter arm 98 of the lever 96 is provided with a pin 102 having a rearwardly extending portion 103 and a forwardly extending portion 104 as shown in FIG. 2. The rearwardly extending portion 103 of the pin 102 extends through a slot 106 formed in the cover 32 into the cavity defined by the housing 26, and is disposed below and proximate the downwardly facing surface of the coin return gate 50. The forwardly extending portion 104 of the pin 102 has one end of a tension spring 108 attached thereto with the opposite end of the spring being attached to a peg 109 which is formed on the cover 32. The spring 108 therefore biases the lockout lever to its first position as shown in FIG. 4.

The relatively longer arm 100 of the lockout lever 96 is provided with a pin 110 which extends through a slot 112 provided in the cover 32 into the cavity defined by the housing 26 so that the pin 110 is disposed below and proximate the angularly downwardly facing surface of the vend gate 52. The relatively longer arm 100 of the lockout lever 96 is also provided with a cam lobe 114 which has a cam follower surface 115 that is in bearing engagement with a second cam surface 116 formed on the vend cam 90 as will hereinafter be described in detail.

Figure 4:
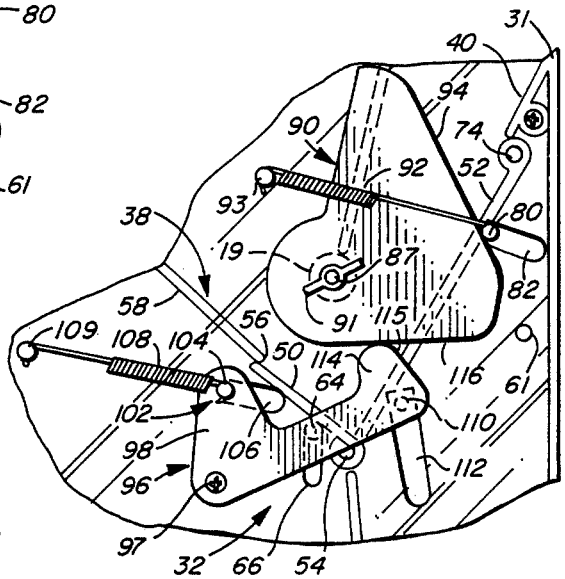
FIG. 4 is a view similar to FIG. 3 with the cover in place and showing the vend cam and lockout cam follower lever in the positions thereof which enable operation of the return gate and lock the vend gate against opening.

When the vend cam 90 is in its normal non-operated position shown in FIG. 4, the tension spring 108 biasingly holds the lockout lever 96 in its first position. When so positioned, the rearwardly extending portion 104 of the pin 102 is laterally disposed with respect to the coin return gate 50 which allows that gate 50 to be moved to its open position. Also, when in this first position, the pin 110 of the lockout lever 96 will be in bearing engagement with the vend gate 52 to prevent it from being opened. Thus, when a person that is using the vending machine has inserted the proper number of coins but has not operated the product selection device (not shown) of the vending machine 12, the vend gate 52 is held closed and the coin return gate 50 may be opened in the event that the person changes his mind.

Figure 5:
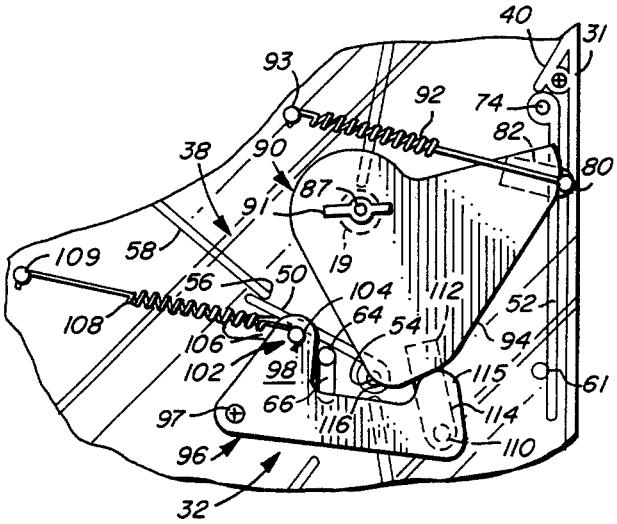
FIG. 5 is a view similar to FIG. 4 and showing the vend cam and lockout lever as having been repositioned to lock the return gate against operation and enable operation of the vend gate.

When the vend shaft 19 is rotatably operated, the vend cam 90 will be rotated to its operated position shown in FIG. 5,and this results in opening of the vend gate 52 as hereinbefore described. The rotational movement of the vend cam 90 will move the lockout lever 96 to its second position shown in FIG. 5 by action of the second cam surface 116 of the vend cam 90 on the cam follower surface 115 of the lockout lever 96. When the lockout lever 96 is pivotably moved to its second position, the pin 110 will be moved downwardly in the slot 112 out of the movement path of the vend gate 52 which is being opened simultaneously with the pivot movement of the lockout lever 96. During the pivot movement of the lockout lever 96 to its second position, the rearwardly extending end 103 of the pin 102 will move in the slot 106 into bearing engagement with the coin return gate 50 thus preventing it from being operated simultaneously with the vend gate 52.

The coin handling apparatus of the present invention is further provided with an invalid coin chute 118 which extends downwardly through the apparatus 10 from a second opening 119 provided in the top wall 28 of the housing 26 and opens above the coin directing bin structure 70 formed in the housing. Thus, invalid coins which fall in the coin reject path 14 from the coin acceptance device 13 will be directed by the invalid coin chute 118 and the coin directing bin structure 70 to the coin return chute 22 of the vending machine 12.

Coins which fall from the escrow box 38 upon opening of the vend gate 52 will fall through a coin acceptance chute 120 formed in the housing 26 immediately below the vend gate. The coin acceptance chute 120 has a bottom outlet which is in communication with the cash box 24 of the vending machine 12 when the coin handling apparatus 10 is mounted therein.

As seen best in FIG. 2, a suitable switch 122 is mounted in the side wall 31 of the housing 26 below the deflector wall 40. When the vend gate 52 is opened, it will move into contact with the switch 122 which results in the sending of a signal to the coin totalizer 42 indicating that a vend operation has been completed. The coin totalizer reacts to the signal from the switch 122 by cancelling the count of the coins from that vend operation and resetting itself for counting the coins which will be inserted into the vending machine 12 for the next vending operation. Simultaneously with the resetting of the coin totalizer 42, the solenoid 44 will be deenergized which retracts its plunger 48 which allows the vend enable latch to return to its vend disabled position.

A second switch 124 is mounted on the rearwardly facing surface of the back wall 27 of the housing 26 as indicated in dashed lines in FIG. 2. The switch 124 is normally contacted by the coin return lever 60 and when that lever is moved from the a position to the b position (FIG. 3), to return the coins to a person who has changes his mind, the switch 124 will send a signal to the coin totalizer 42 which reacts to that signal in exactly the same manner as it reacts to a signal from the switch 122.

While the principles of the invention have now been made clear in the illustrated embodiment, there will be immediately obvious to those skilled in the art, many modification of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A coin handling apparatus for use in a vending machine comprising:

(a) housing means defining an internal caivty;

(b) an escrow box in the internal cavity of said housing means for receiving coins from the vending machine, said escrow box including, I. a first pivot pin means in the internal cavity of said housing means, II. a coin return gate having one end mounted on said first pivot pin means for pivotable movement from a normally closed position wherein said coin return gate extends angularly upwardly from said first pivot pin means to an open position wherein said coin return gate extends angularly downwardly from said first pivot pin means, III. a second pivot pin means in the internal cavity of said housing means in angularly upwardly spaced relationship with respect to said first pivot pin means, IV. a vend gate having one end mounted on said second pivot pin means and having an extending end, said vend gate being pivotably movable from a normally closed position wherein it extends angularly downwardly from said second pivot pin means with its extending end in bearing engagement with the one end of said coin return gate to an open position wherein the extending end of said vend gate is spaced from the one end of said coin return gate;

(c) biasing means connected between said housing means and said vend gate to bias said vend gate to its closed position; and (d) a vend cam rotatably movable on said housing means and having a cam surface, said vend cam being rotatably movable from an inoperative position to an operative position wherein the cam surface thereof is in bearing engagement with said vend gate to move said vend gate to its open position against the bias applied thereto by said biasing means.

2. A coin handling apparatus as claimed in claim 1 and further comprising a coin return lever mounted on said housing means for movement between a first and a second position, said coin return lever being in engagement with said coin return gate to hold said coin return gate in the closed position thereof when said coin return lever is in its first position and allowing said coin return gate to move to its open position when said coin return lever is moved to its second position.

3. A coin handling apparatus as claimed in claim 2 and further comprising biasing means connected between said housing means and said coin return lever to bias said coin return lever to its first position.

4. A coin handling apparatus as claimed in claim 1 and further comprising:

(a) a lockout lever mounted on said housing means for pivotable movement between first and second positions;

(b) second biasing means connected between said housing means and said lockout lever for biasing said lockout lever to its first positon;

(c) first means extending from said lockout lever into the proximity of said coin return gate, said first means being in engagement with said coin return gate to hold it closed when said lockout lever is in the second position thereof, said first means being movable with said lockout lever out of engagement with said coin return gate to allow it to move to its open position when said lockout lever is moved to its first positioin; and (d) second means extending from said lockout lever into proximity with said vend gate, said second means being in engagement with said vend gate to hold it closed when said lockout lever is in its first position, said second means being movable with said lockout lever out of engagement with said vend gate to allow said vend gate to its open position when said lockout lever is moved to its second position.

5. A coin handling apparatus as claimed in claim 4 wherein said lockout lever is in bearing engagement with said vend cam so that said lockout lever will be pivotably moved to its second position by said vend cam when said vend cam is rotated to its operating position.

6. A coin handling apparatus for mounting in a vending machine of the type having a rotatable vend shaft and a linearly movable coin return actuator bar, said coin handling apparatus comprising:

(a) a housing having a back wall and defining a forwardly opening cavity;

(b) a cover mounted on said housing to close the forwardly opening cavity thereof;

(c) an escrow box in the cavity of said housing for receiving coins from the vending machine, said escrow box including, I. first pivot pin means in the cavity of said housing, II. a coin return gate having one end mounted on said first pivot means for movement from a closed position wherein said coin return gate extends angularly upwardly from said first pivot pin means to an open position wherein said coin return gate extends angularly downwardly from said first pivot pin means, III. second pin means in the cavity of said housing in angularly upwardly spaced relationship with respect to said first pivot pin means, IV. a vend gate having one end mounted on said second pivot pin means and having an extending end, said vend gate being movable from a closed position wherein it extends angularly downwardly from said second pivot pin means with its extending end in bearing engagement with the one end of said coin return gate to an open position wherein the extending end of said vend gate is spaced from the one end of said coin return gate;

(d) a coin return lever mounted on the exterior surface of the back wall of said housing and movable between first and second positions, said coin return lever being disposed proximate the coin return actuator bar of the vending machine when said coin handling apparatus is mounted therein for moving between the first and second positions thereof in response to the linear movement of the coin return actuator bar;

(e) biasing means connected between the back wall of said housing and said coin return lever for biasing said coin return lever to its first position; and (f) means extending from said coin return lever through the back wall of said housing into the cavity thereof proximate said coin return gate, said means being in bearing engagement with said coin return gate to hold it closed when said coin return lever is in the first position thereof and to allow said coin return gate to move to the open position when said coin return lever is in the second position thereof.

7. A coin handling apparatus as claimed in claim 6 and further comprising:

(a) said vend gate having an operating pin means extending therefrom through said front cover; and (b) first biasing means having one end connected to the exterior surface of said cover with its other end connected to the operating pin of said vend gate to bias said vend gate to the closed position.

8. A coin handling apparatus as claimed in claim 7 and further comprising aperture means aligningly formed through the back wall of said housing and said cover for receiving the vend shaft of the the vending machine when said coin handling apparatus is mounted therein with the extending end of the vend shaft being disposed proximate the exterior surface of said cover.

9. A coin handling apparatus as claimed in claim 8 and further comprising a vend cam for attachment to the extending end of the vend shaft for rotational movement therewith between an inoperative position and an operative position, said vend cam having a first cam surface which moves into bearing engagement with the operating pin of said vend gate upon rotational movement of said vend cam to the operative position thereof to move said vend gate to its open position against the bias applied thereto by said first biasing means.

10. A coin handling apparatus as claimed in claim 9 and further comprising:

(a) a lockout lever mounted on the exterior surface of said cover for pivotable movement between first and second positions;

(b) second biasing means connected between said cover and said lockout lever for biasing thereof to the first position; and (c) first pin means extending from said lockout lever through said cover into the cavity of said housing proximate said coin return gate, said first pin means being disposed to allow said coin return gate to be opened when said lockout lever is in the first position thereof and in bearing engagement with said coin return gate to hold it closed when said lockout lever is in the second position thereof.

11. A coin handling apparatus as claimed in claim 10 and further comprising second pin means extending from said lockout lever through said cover into the cavity of said housing proximate said vend gate, said second pin means being disposed in bearing engagement with said vend gate to hold it closed when said lockout lever is in the first position thereof and is disposed out of engagement with said vend gate to allow opening thereof when said lockout lever is in the second position thereof.

12. A coin handling apparatus as claimed in claim 11 and further comprising:

(a) said vend cam having a second cam surface formed thereon; and (b) a cam follower surface formed on said lockout lever with said cam follower surface being in bearing engagement with the second cam surface of said vend cam for positioning said lockout lever in the first position thereof when said vend cam is in its inoperative position and moving said lockout lever to the second position thereof upon rotational movement of said vend cam to its operative position.

13. A coin handling apparatus as claimed in claim 6 and further comprising:

(a) a coin detector in the cavity of said housing for receiving coins from the vending machine and producing signals indicative of the values of the received coins and directing the received coins to said escrow box;

(b) a coin totalizer in the cavity of said housing and coupled to said coin detector for receiving the signals produced thereby, said coin totalizer producing a vend enable signal when the value of the coins detected by said coin detector equals a predetermined value; and (c) transducer means mounted in the cavity of said housing for receiving the vend enable signal from said coin totalizer and producing a movement in response thereto, said transducer means being connected to the vending machine when said coin handling apparatus is mounted thereon with the vending machine sensing the movement of said transducer means and reacting by freeing the vend shaft thereof for rotational movement.

14. A coin handling apparatus as claimed in claim 6 and further comprising an invalid coin chute in the cavity of said housing for receiving invalid coins from the vending machine and directing the received invalid coins back to the vending machine.

15. A coin handling apparatus as claimed in claim 6 and further comprising a coin acceptance chute in the cavity of said housing immediately below said vend gate for receiving coins from said escrow box when said vend gate is opened and directing those coins to the vending machine.

16. A coin handling apparatus for mounting in a vending machine of the type having a rotatable vend shaft in a linearly movable coin return actuator bar, said coin handling apparatus comprising:

(a) a housing having a back wall and defining a forwardly opening cavity;

(b) a cover mounted on said housing to close the forwardly opening cavity thereof;

(c) an escrow box in the cavity of said housing for receiving coins from the vending machine, said escrow box including, I. first pivot pin means in the cavity of said housing, II. a coin return gate having one end mounted on said first pivot pin means for movement from a closed position wherein said coin return gate extends angularly upwardly from said first pivot pin means to an open position wherein said coin return gate extends angularly downwardly from said first pivot pin means, III. second pivot pin means in the cavity of said housing in angularly upwardly spaced relationship with respect to said first pivot pin means, IV. a vend gate having one end mounted on said second pivot pin means and having an extending end, said vend gate being movable from a closed position wherein it extends angularly downwardly from said second pivot pin means with its extending end in bearing engagement with the one end of said coin return gate to an open position wherein the extending end of said vend gate is spaced from the one end of said coin return gate;

(d) said vend gate having an operating pin means extending therefrom through said front cover; and (e) first biasing means having one end connected to the exterior surface of said cover with its other end connected to the operating pin of said vend gate to bias said vend gate to the closed position.

17. A coin handling apparatus as claimed in claim 16 and further comprising:

(a) a coin return lever mounted on the exterior surface of the back wall of said housing and movable between first and second positions, said coin return lever being disposed proximate the coin return actuator bar of the vending machine when said coin handling apparatus is mounted therein for moving between the first and second positions thereof in response to the linear movements of the coin return actuator bar;

(b) biasing means connected between the back wall of said housing and said coin return lever for biasing said coin return lever to its first position; and (c) means extending from said coin return lever through the back wall of said housing into the cavity thereof proximate said coin return gate, said means being in bearing engagement with said coin return gate to hold it closed when said coin return lever is in the first position thereof and to allow said coin return gate to move to the open position when said coin return lever is in the second position thereof.

18. A coin handling apparatus as claimed in claim 16 and further comprising aperture means aligningly formed through the back wall of said housing and said cover for receiving the vend shaft of the vending machine when said coin handling apparatus is mounted therein with the extending end of the vend shaft being disposed proximate the exterior surface of said cover.

19. A coin handling apparatus as claimed in claim 18 and further comprising a vend cam for attachment to the extending end of the vend shaft for rotational movement therewith between an inoperative position and an operative position, said vend cam having a first cam surface which moves into bearing engagement with the operating pin of said vend gate upon rotational movement of said vend cam to the operative position thereof to move said vend gate to its open position against the bias applied thereto by said first biasing means.

20. A coin handling apparatus as claimed in claim 19 and further comprising:

(a) a lockout lever mounted on the exterior surface of said cover for pivotable movement between first and second positions;

(b) second biasing means connected between said cover and said lockout lever for biasing thereof to its first position; and (c) first pin means extending from said lockout lever through said cover into the cavity of said housing proximate said coin return gate, said first pin means being disposed to allow said coin return gate to be opened when said lockout lever is in the first position thereof and in hearing engagement with said coin return gate to hold it closed when said lockout lever is in the second position thereof.

21. A coin handling apparatus as claimed in claim 20 and further comprising second pin means extending from said lockout lever through said cover into the cavity of said housing proximate said vend gate, said second pin means being disposed in bearing engagement with said vend gate to hold it closed when said lockout lever is in the first position thereof and is disposed out of engagement with said vend gate to allow opening thereof when said lockout lever is in the second position thereof.

22. A coin handling apparatus as claimed in claim 21 and further comprising:

(a) said vend cam having a second cam surface formed thereon; and (b) a cam follower surface formed on said lockout lever with said cam follower surface being in bearing engagement with the second cam surface of said vend cam for positioning said lockout lever in the first position thereof when said vend cam is in its inoperative position and moving said lockout lever to the second position thereof upon rotational movement of said vend cam to its operative position.

23. A coin handling apparatus for mounting in a vending machine of the type having a rotatable vend shaft and a linearly movable coin return actuator bar, said coin handling apparatus comprising:

(a) a housing having a back wall and defining a forwardly opening cavity;

(b) a cover mounted on said housing to close the forwardly opening cavity thereof;

(c) an escrow box in the cavity of said housing for receiving coins from the vending machine, said escrow box including, I. a first pivot pin means in the cavity of said housing, II. a coin return gate having one end mounted on said first pivot pin means for movement from a closed position wherein said coin return gate extends angularly upwardly from said first pivot pin means to an open position wherein said coin return gate extends angularly downwardly from said first pivot pin means, III. second pivot means in the cavity of said housing in angularly upwardly spaced relationship with respect to said first pivot pin means, IV. a vend gate having one end mounted on said second pivot pin means and having an extending end, said vend gate being movable from a closed position wherein it extends angularly downwardly from said second pivot pin means with its extending end in bearing engagement with the one end of said coin return gate to an open position wherein the extending end of said vend gate is spaced from the one end of said coin return gate;

(d) a coin detector in the cavity of said housing for receiving coins from the vending machine and producing signals indicative of the values of the received coins and directing the received coins to said escrow box;

(e) a coin totalizer in the cavity of said housing and coupled to said coin detector for receiving the signals produced thereby, said coin totalizer producing a vend enable signal when the value of the coins detected by said coin detector equals a predetermined value; and (f) transducer means mounted in the cavity of said housing for receiving the vend enable signal from said coin totalizer and producing a movement in response thereto, said transducer means being connected to the vending machine when said coin handling apparatus is mounted thereon with the vending machine sensing the movement of said transducer means and reacting by freeing the vend shaft thereof for rotational movement.

* * * * *